US010700446B2

(12) United States Patent
Tamura et al.

(10) Patent No.: US 10,700,446 B2
(45) Date of Patent: Jun. 30, 2020

(54) CONNECTOR

(71) Applicant: Molex, LLC, Lisle, IL (US)

(72) Inventors: Naoyoshi Tamura, Lisle, IL (US); Takeshi Tsukahara, Lisle, IL (US); Taku Yanagihashi, Lisle, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/333,242

(22) PCT Filed: Jan. 3, 2018

(86) PCT No.: PCT/US2018/012219
§ 371 (c)(1),
(2) Date: Mar. 14, 2019

(87) PCT Pub. No.: WO2018/136231
PCT Pub. Date: Jul. 26, 2018

(65) Prior Publication Data

US 2020/0014124 A1 Jan. 9, 2020

(30) Foreign Application Priority Data

Jan. 17, 2017 (JP) ..... 2017-006007

(51) Int. Cl.
*H01R 4/14* (2006.01)

(52) U.S. Cl.
CPC ..... *H01R 4/14* (2013.01)

(58) Field of Classification Search
CPC ..... H01R 12/62; H01R 12/79; H01R 12/592; H01R 12/59; H01R 23/668; H01R 4/14
USPC ..... 439/67, 77, 492, 495
See application file for complete search history.

(56) References Cited

U.S. PATENT DOCUMENTS 3,633,189 A * 1/1972 Billawala ..... G11B 5/17 360/245.8
4,621,882 A * 11/1986 Krumme ..... H01R 4/01 439/161
7,766,838 B2 * 8/2010 Yagi ..... A61B 8/12 600/459
9,721,714 B1 * 8/2017 Sun ..... H05K 1/165
(Continued)

FOREIGN PATENT DOCUMENTS

CN 202189983 U 4/2012
CN 202736536 U 2/2013
(Continued)

OTHER PUBLICATIONS

International Search Report and Written Opinion received for PCT application No. PCT/US2018/012219, dated Apr. 30, 2018, 7 pages.

*Primary Examiner* — Gary F Paumen
(74) *Attorney, Agent, or Firm* — Molex, LLC

(57) ABSTRACT

A connector is provided having a shaft member and a wire substrate. The wire substrate is wound helically on a surface of the shaft member. The wire substrate includes a band-shaped base material, a plurality of conductive wires provided on one surface of the base material, and a plurality of contact pads provided on another surface of the base material. Each of the conductive wires is connected to each of the contact pads, and the contact pads are exposed on an outside of the wire substrate aligned so as to open a gap in a length direction of the shaft member, in a state where the wire substrate is wound helically on the surface of the shaft member.

7 Claims, 16 Drawing Sheets

(56) References Cited

U.S. PATENT DOCUMENTS

| | | | | |
|---|---|---|---|---|
| 2004/0192080 | A1* | 9/2004 | Li | H01R 13/2407 439/66 |
| 2007/0276458 | A1 | 11/2007 | Boser | |
| 2008/0182435 | A1* | 7/2008 | Ho | H01R 35/025 439/77 |
| 2010/0022137 | A1 | 1/2010 | Mcalonis et al. | |
| 2015/0129278 | A1* | 5/2015 | Li | H01B 7/0892 174/107 |
| 2015/0273184 | A1* | 10/2015 | Scott | A61B 5/6852 604/523 |
| 2016/0172794 | A1 | 6/2016 | Sparrowhawk et al. | |

FOREIGN PATENT DOCUMENTS

| | | | |
|---|---|---|---|
| JP | H10-134640 | A | 5/1998 |
| WO | 2018/136231 | A1 | 7/2018 |

* cited by examiner

CONNECTOR

RELATED APPLICATIONS

This application claims priority to PCT application no. PCT/US2018/012219, filed on Jan. 3, 2018, which further claims the priority to Japanese Application No. 2017-006007, filed Jan. 17, 2017, which are incorporated herein by reference in their entirety.

TECHNICAL FIELD

The present disclosure relates to a connector.

BACKGROUND ART

Conventionally, harness-shaped multi-core cables formed by gathering and integrating a multiplicity of electric wires are used in transport equipment, and the like, as wiring inside the equipment or to connect an equipment main unit and display. While flat cables, in which a multiplicity of electric wires, both ends of which are connected to electrical connectors, are aligned in parallel at a predetermined pitch are typically used in such cases, cylindrical cables are sometimes configured by winding flat cables helically in order to make handling easier (for example, see Patent Document 1).

FIG. 16 is a perspective view of a conventional cylindrical cable.

In the figure, 801 is a flat cable in which a plurality of electric wires 851 aligned in parallel have been integrated using an insulator. The flat cable 801 is wound helically around a circumference of a core material 811 made from a material having superior tensile resistance made from aramid fiber, and the like. Furthermore, a circumference of the helically wound flat cable 801 is covered by a cylindrically rounded metal tape 861, and a circumference of the cylindrically rounded metal tape 861 is covered by a resin sheath 821. Therefore, the helically wound flat cable 801 is reliably protected from wear and damage.

Patent Document 1: JP H10-134640

SUMMARY

However, with this conventional technology, if the dimensions of the flat cable 801 are made fine and the electric wires 851 are thus made even finer, it becomes difficult to reliably connect the flat cable 801 to a circuit board or a counterpart member, such as a connector, and the like.

Here, an object is to resolve the conventional problems and to provide a connector that can be provided even in a small diameter, narrow space, and that can reliably mate with a counterpart connector.

Therefore, a shaft member and a wire substrate wound helically on a surface of the shaft member are provided in a connector, where the wire substrate includes a band-shaped base material, a plurality of conductive wires provided on one surface of the base material, and a plurality of contact pads provided on the other surface of the base material, each of the conductive wires is connected to each of the contact pads, and the contact pads are exposed on an outside of the wire substrate aligned so as to open a gap in a length direction of the shaft member, in a state where the wire substrate is wound helically onto the surface of the shaft member.

In another connector, the base material also includes a margin on both width direction ends, where neither the conductive wires nor the contact pads are present, and the margins of adjoining base materials at least partially overlap one another, in a state where the wire substrate is helically wound onto the surface of the shaft member.

In yet another connector, the contact pads are also formed connected in a length direction of the wire substrate and are exposed on the outside of the wire substrate over a predetermined length with respect to the length direction of the shaft member, in a state where the wire substrate is helically wound onto the surface of the shaft member.

In yet another connector, the contact pads are also separated and formed into a plurality of pad parts so as to align opening a gap in the length direction of the wire substrate, where the pad parts form a long thin row longitudinal to the shaft member, in a state where the wire substrate is helically wound onto the surface of the shaft member.

In yet another connector, the wire substrate also includes a main body part wound helically onto the surface of the shaft member and a free end not wound helically onto the surface of the shaft member, where a plurality of electric wire connecting pads able to connect a terminus of an electric wire, which are electric wire connecting pads each connected to a corresponding conductive wire, are connected to the free end.

In yet another connector, a length direction of the free end is also inclined with respect to a length direction of the main body part and parallel to the length direction of the shaft member, where the free end includes a narrow part and a folding part that is wider than the narrow part, and the folding part matches a slit extending the length direction and is folded using the slit as a fold.

In yet another connector, several of the conductive wires are also provided in the narrow part on one surface of the base material while the other conductive wires are provided on the other surface of the base material, and all of the conductive wires and electric wire connecting pads are provided in the folding part on the other surface of the base material.

In yet another connector, a securing pad is also formed in the folding part on one surface of the base material, and the securing pad is secured via soldering near one end of the shaft member.

According to the present disclosure, it is possible to provide a connector that can reliably mate with a counterpart connector, even in a small diameter, narrow space.

BRIEF DESCRIPTION OF THE DRAWINGS

FIG. 6A is an overall view thereof, and FIG. 6B is an enlarged view of Part B in FIG. 6A.

FIG. 7A is a view illustrating a state during winding, and FIG. 7B is a view illustrating a state after winding has been completed.

DETAILED DESCRIPTION OF THE PREFERRED EMBODIMENTS

Embodiments will be described in detail below with reference to the drawings.

Figure 1:
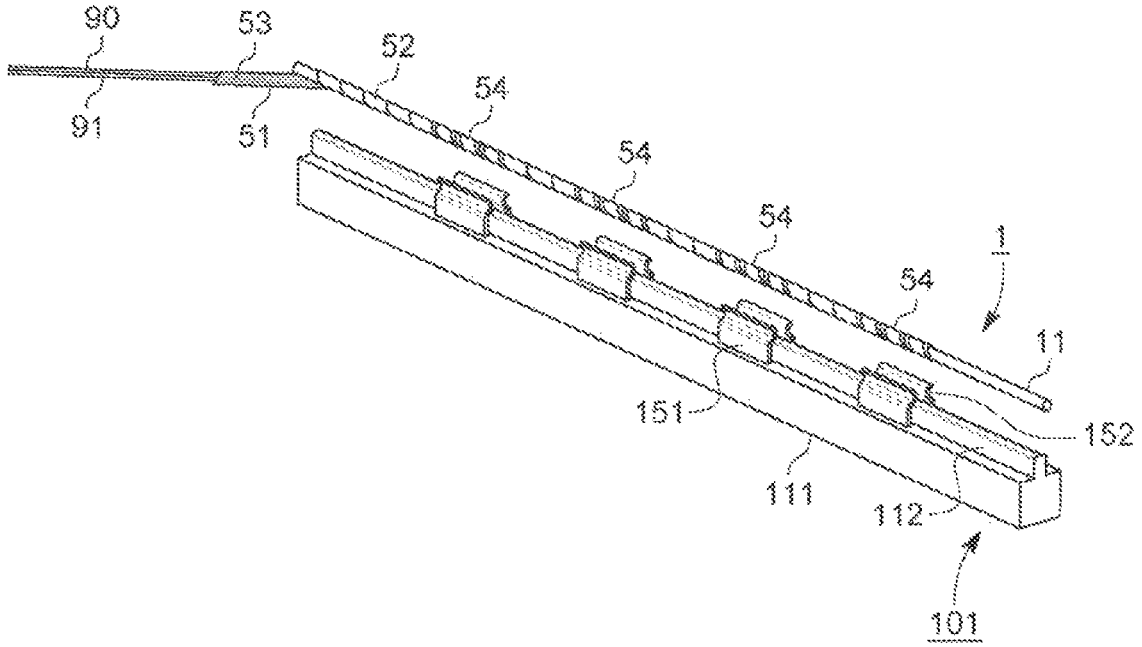
FIG. 1 is a perspective view illustrating a connector and a counterpart connector prior to being joined together according to a first embodiment.
Figure 2:
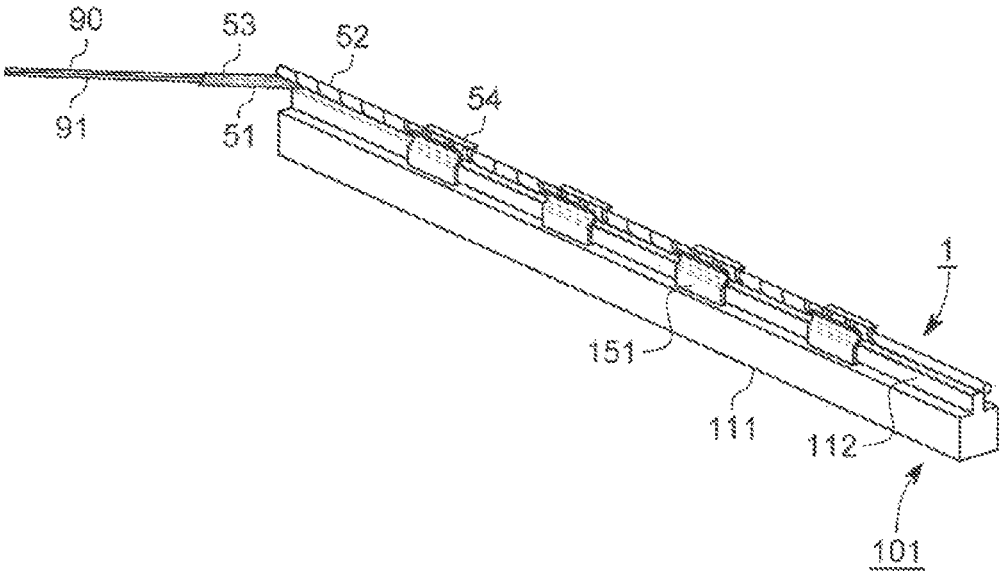
FIG. 2 is a perspective view illustrating the connector and the counterpart connector after being joined together according to the first embodiment.

FIG. 1 is a perspective view illustrating a connector and a counterpart connector prior to being joined together in a first embodiment, and FIG. 2 is a perspective view illustrating the connector and the counterpart connector after being joined together according to the first embodiment.

In the figures, 1 is a cable connector serving as a connector according to the present embodiment and is connected to a terminus of a cable 90 provided with a plurality of electric wires 91. As long as the cable 90 is used as a wire in various types of electronic equipment, medical equipment, industrial equipment, transport equipment, and the like, such as, for example, a personal computer, a smart phone, and the like, said cable can be of any type, however, said cable is described here as an extremely fine cable where an outer diameter of the electric wire 91 is no more than 0.01 mm.

Furthermore, 101 is a mating connector serving as a counterpart connector according to the present embodiment, and is mounted on a surface of a substrate, such as a printed circuit board, a flexible printed circuit (FPC), and the like, and used after being connected to a terminus of a cable such as an electric wire cable, a flexible flat cable (FFC), and the like, however, said connector may be of any type as long as it can mate with the cable connector 1.

Note that expressions for indicating directions such as up, down, left, right, front, back, and the like, used to describe the operations and configurations of the parts of the cable connector 1 and the mating connector 101 according to the present embodiment are not absolute but rather relative directions, and though appropriate when the parts of the cable connector 1 and the mating connector 101 are in the positions illustrated in the figures, these directions should be interpreted differently when these positions change, so as to correspond to said change.

In the example illustrated in the figures, the mating connector 101 is provided with a counterpart housing 111 made from an insulating material such as resin, and the like, and a plurality (four in the example illustrated in the figures, but not limited thereto) of counterpart terminals 151 mounted in the counterpart housing 111. The counterpart terminals 151 are provided in a length direction of the counterpart housing 111 with predetermined gaps open therebetween. Furthermore, the counterpart housing 111 is a long thin rod-shaped member extending upward from an upper surface, and includes a convex part 112 extending in a length direction of the counterpart housing 111. Each of the counterpart terminals 151 includes a pair of contacting arm parts 152 provided so as to sandwich the convex part 112 from both sides.

The cable connector 1 is provided with a long thin cylindrical shaft member 11, and a wire substrate 51, onto which a main body part 52 is wound helically, on a circumference of the shaft member 11. The shaft member 11 may be made from any material, such as, for example, a metal, such as stainless steel, and the like, or an insulating material, such as resin, and the like. Note that when the shaft member 11 is made from a conductive material, such a metal, and the like, an insulating layer not illustrated in the figures is formed on a circumferential surface of the shaft member 11. A proximal end vicinity of the wire substrate 51 is a free end 53 not wound onto the shaft member 11 or otherwise constrained, and a terminus of the cable 90 is connected to the free end 53. A contact pad 54 is exposed in a plurality of locations (four in the example illustrated in the figures, but not limited thereto) on an outer surface of the main body part 52 wound on the circumference of the shaft member 11. Each of the contact pads 54 is connected to each of the conductive wires 55 to be described below provided on the wire substrate 51.

Furthermore, as illustrated in FIG. 2, when the cable connector 1 and the mating connector 101 are mated together, the cable connector 1 is sandwiched by the contacting arm parts 152 of the counterpart terminals 151 and thus secured in the counterpart housing 111, while each of the contact pads 54 makes contact with and is thus electrically connected to a corresponding contacting arm part 152. Therefore, corresponding conductive wires 55 and counterpart terminals 151 are electrically connected.

A configuration of the cable connector 1 will be described in detail below.

Figure 3:
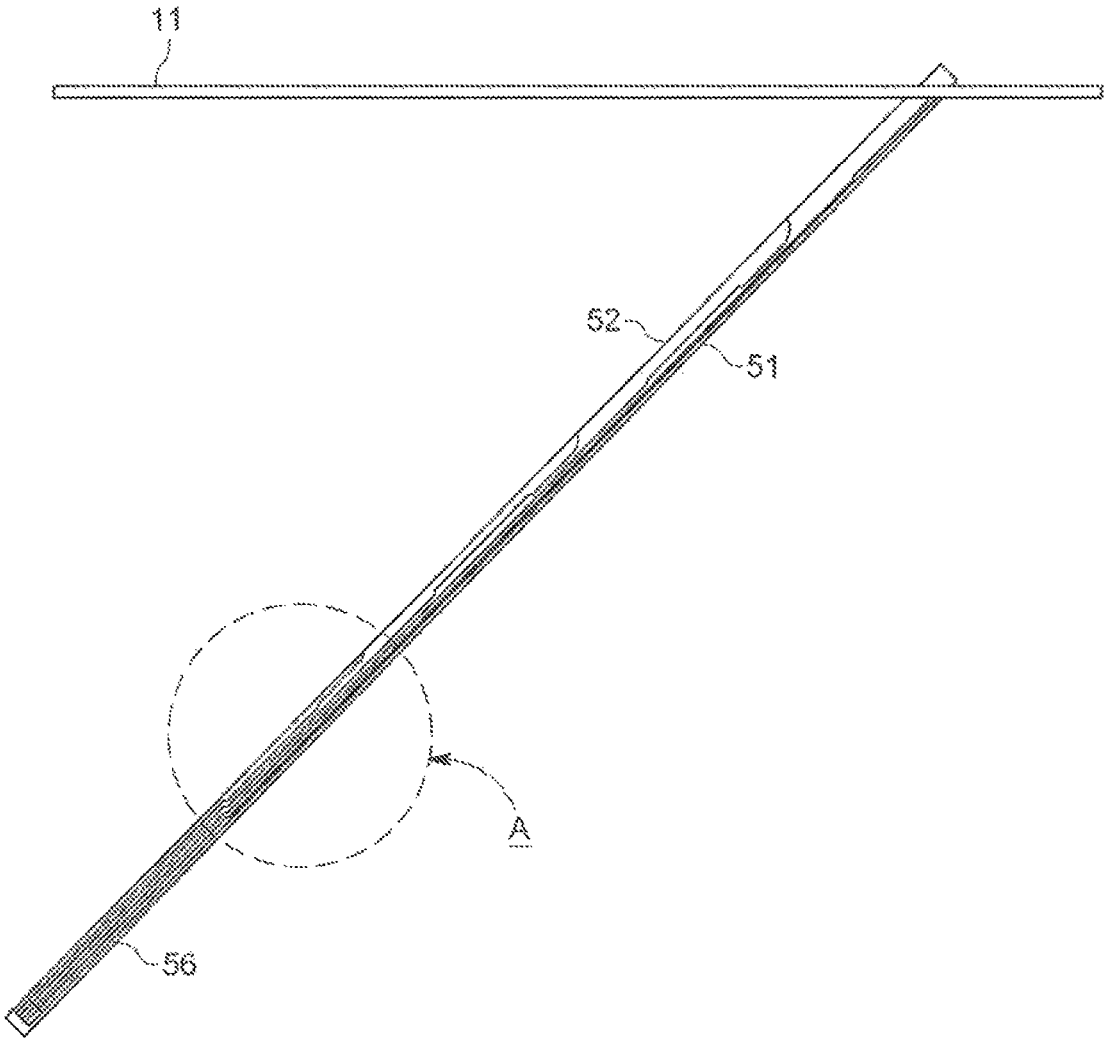
FIG. 3 is a first view illustrating a state at the start of winding a wire substrate onto a shaft member according to the first embodiment.
Figure 4:
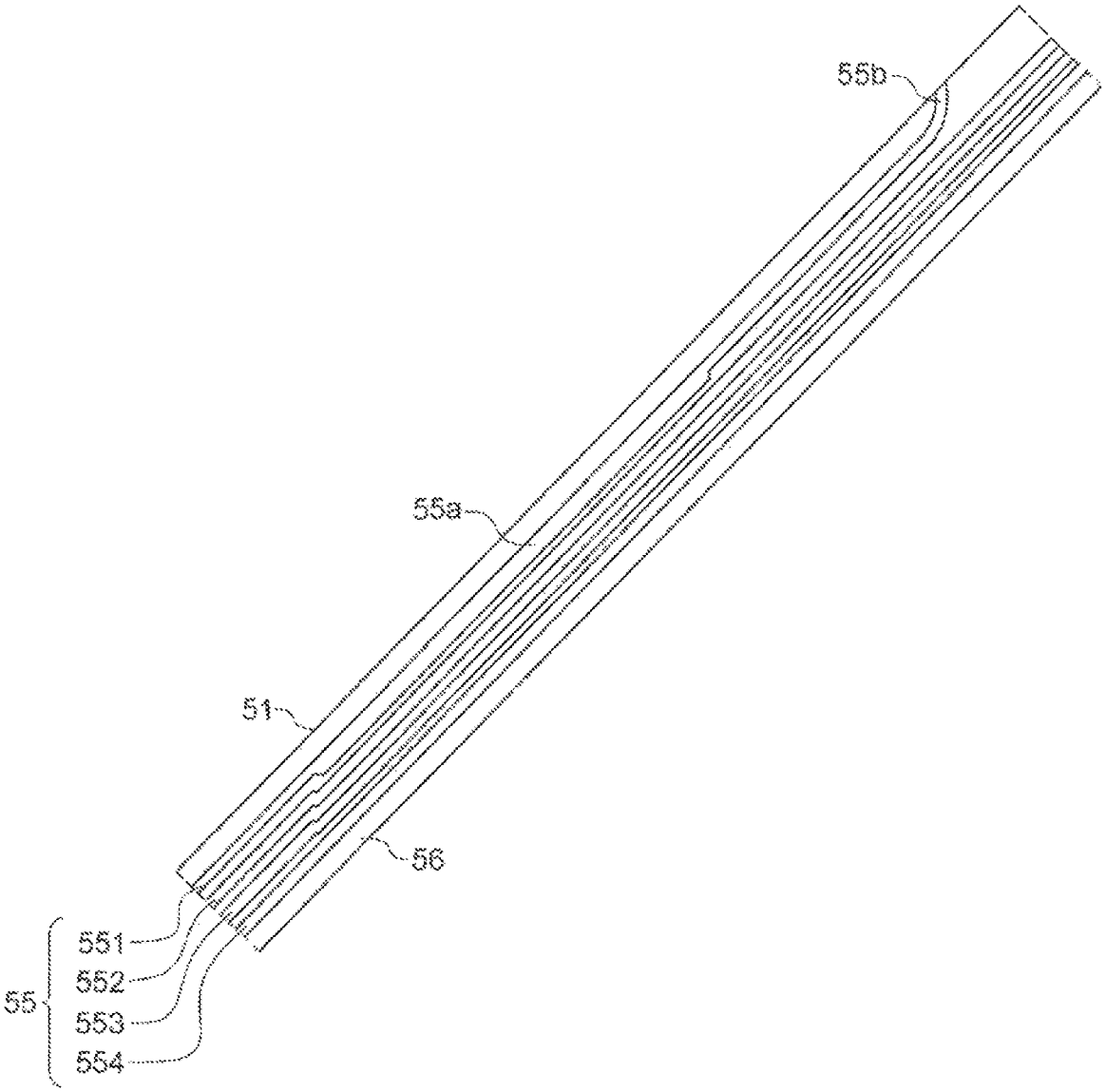
FIG. 4 is an enlarged view of Part A in FIG. 3, which is an enlarged view of the main components of the wire substrate according to the first embodiment.
Figure 5:
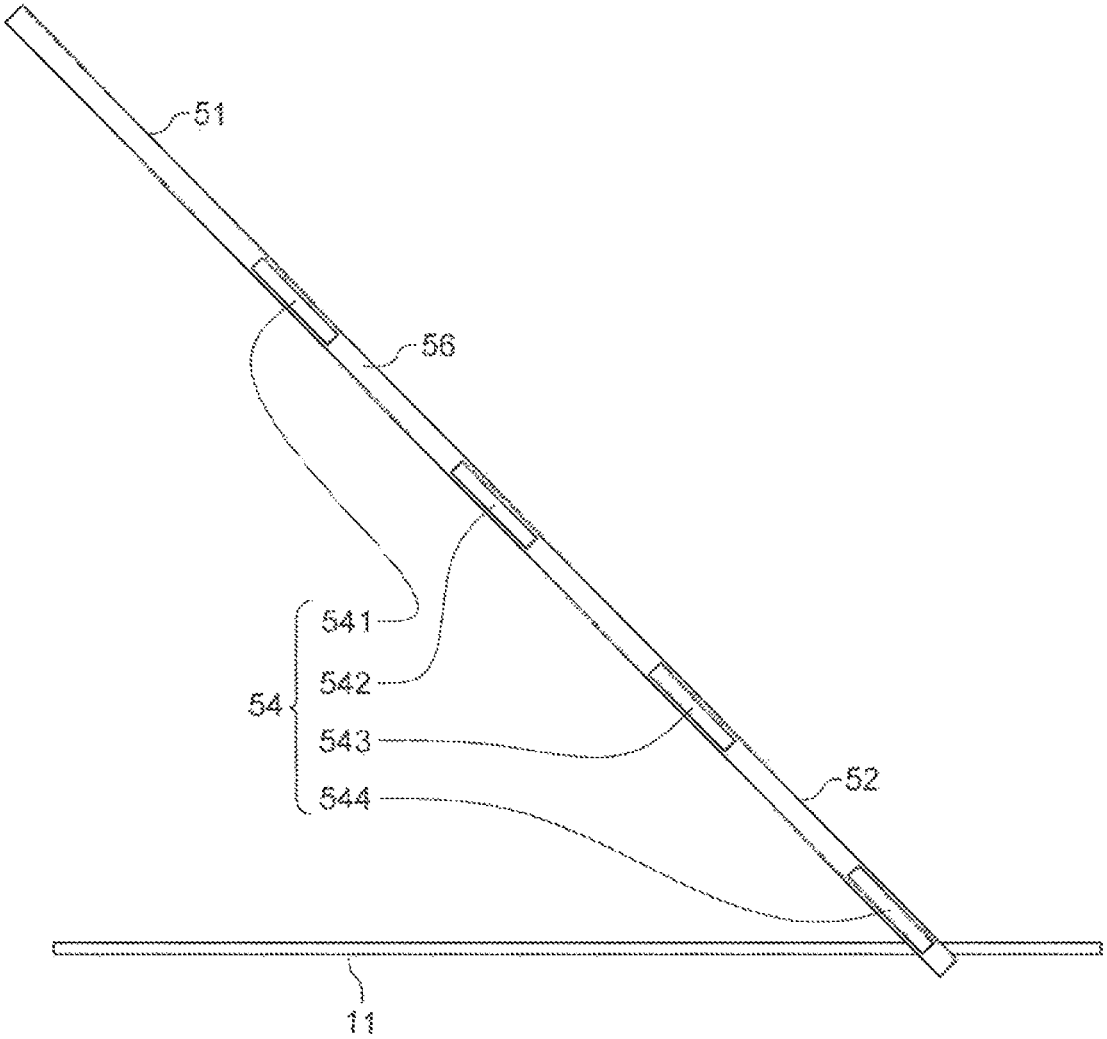
FIG. 5 is a second view illustrating a state at the start of winding the wire substrate onto the shaft member according to the first embodiment.
Figure 6A:
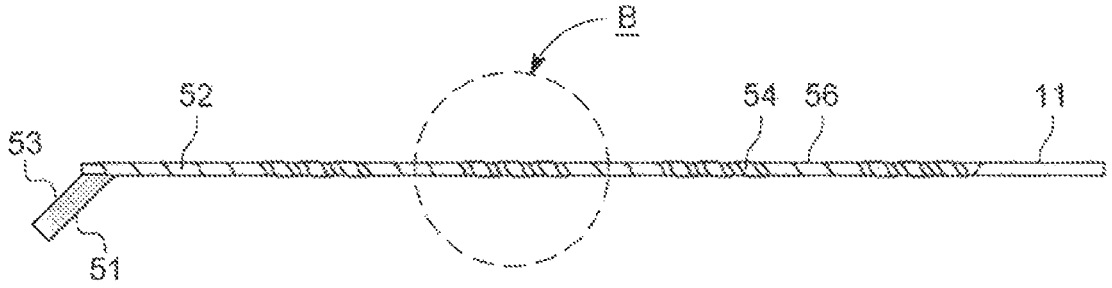
FIGS. 6A and 6B are views illustrating a state at the end of winding the wire substrate onto the shaft member according to the first embodiment, where
Figure 6B:
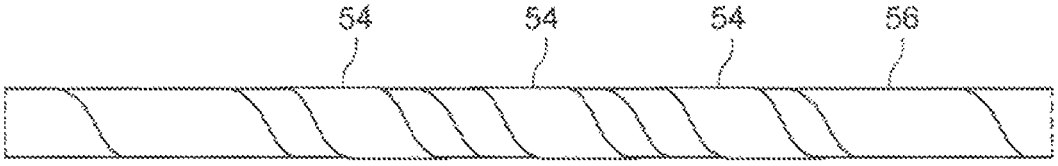
Figure 7A:
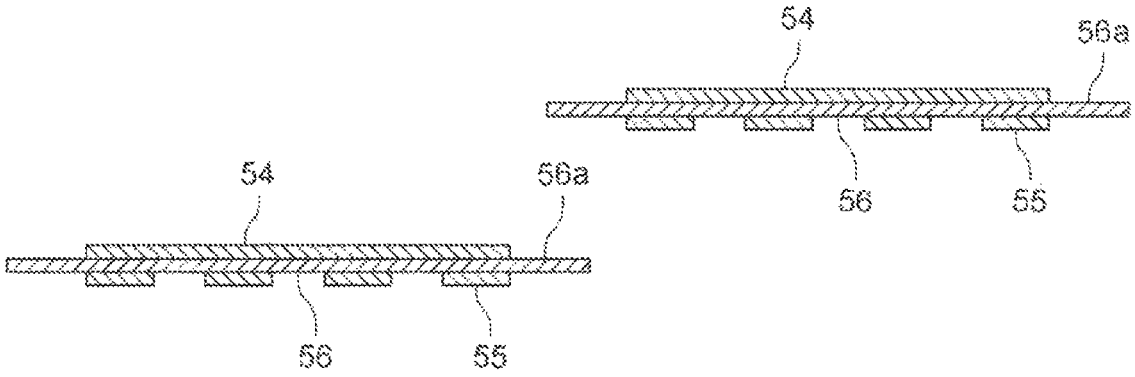
FIGS. 7A and 7B are side cross-sectional views of the wire substrate according to the first embodiment, where
Figure 7B:
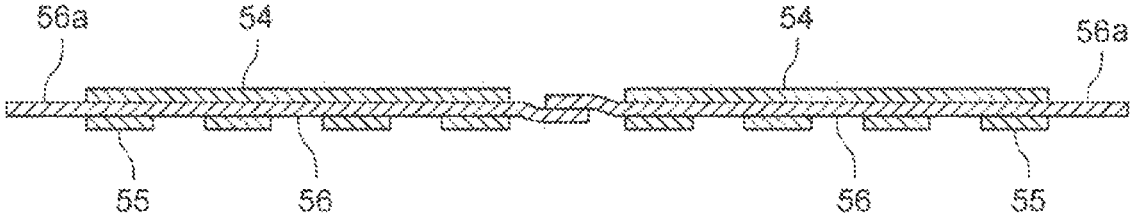
Figure 8:
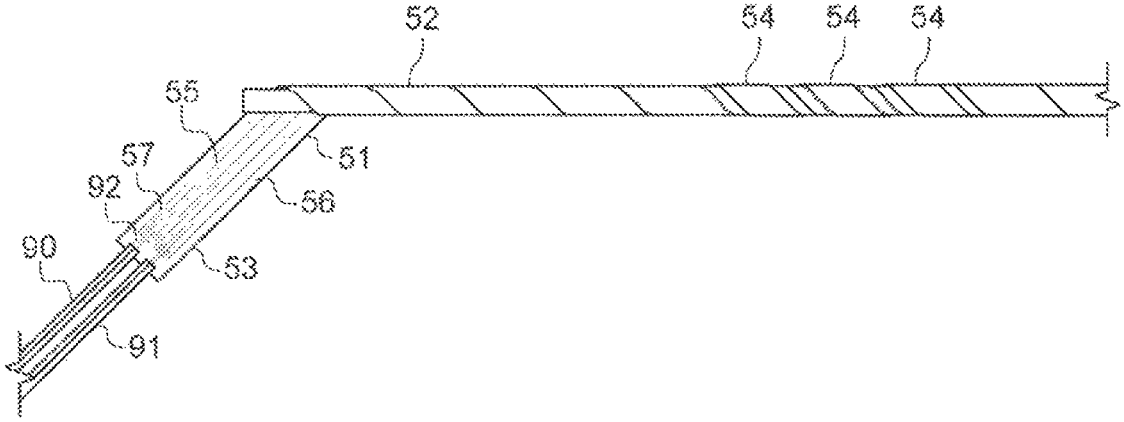
FIG. 8 illustrates a state where a cable is connected to the wire substrate according to the first embodiment.

FIG. 3 is a first view illustrating a state at the start of winding a wire substrate onto a shaft member according to the first embodiment, FIG. 4 is an enlarged view of Part A in FIG. 3, which is an enlarged view of the main components of the wire substrate according to the first embodiment, FIG. 5 is a second view illustrating a state at the start of winding the wire substrate onto the shaft member according to the first embodiment, FIGS. 6A and 6B are views illustrating a state at the end of winding a wire substrate onto a shaft member in a second embodiment, FIGS. 7A and 7B are side cross-sectional views of the wire substrate according to the first embodiment, and FIG. 8 illustrates a state where a cable is connected to the wire substrate according to the first embodiment. Note that, FIG. 6A is an overall view, and FIG. 6B is an enlarged view of Part B in FIG. 6A, and, FIG. 7A is a view illustrating a state during winding, and FIG. 7B is a view illustrating a state after winding has been completed.

As illustrated in the figures, the wire substrate 51 is, for example a member known as a flexible printed circuit board, and is a member where a plurality (four in the example illustrated in the figures, but not limited thereto) of conductive wires 55 made from, for example, a conductive metal, such as a copper alloy, and the like, are aligned in parallel at a predetermined pitch extending in a length direction of a long thin band-shaped insulating base material 56 made from an insulating material such as a flexible resin, and the like, on one surface of said base material 56. Note that the wire substrate 51 does not necessarily have to be a flexible printed circuit and thus may be any type of member so long as it is a member where the plurality of conductive wires 55 are provided on the surface of the tape-like flexible, insulating base material 56. Furthermore, an insulating film for covering the surface of the conductive wires 55 provided on the surface of the base material 56 can be formed as needed.

As illustrated in FIG. 3, the length direction of the wire substrate 51 is inclined with respect to the length direction of the shaft member 11, and the winding of the substrate onto the shaft member 11 begins in a position where the one surface on which the conductive wires 55 are provided is an inner surface, that is, in a position where said surface faces the surface of the shaft member 11, and the substrate is thus helically wound onto the circumference of the shaft member 11. Furthermore, when the winding of the wire substrate 51 onto the shaft member 11 is finished, the substrate and the shaft member appear as illustrated in FIG. 6A. It is preferable that the fully wound wire substrate 51 be secured to the shaft member 11 via securing means, such as an adhesive, or the like, using some part of said substrate, for example, both end parts, or the like, of the main body part 52 wound onto the shaft member 11. For example, an insulating layer formed between the circumferential surface of the shaft member 11 and an inner surface of the main body part 52 wound onto the shaft member 11 may be provided with adhesive properties.

As illustrated in FIG. 5, the wire substrate 51 according to the present embodiment is provided with the contact pad 54 made from, for example, a copper alloy, or the like, provided on the other surface (surface on the side opposite the surface where the conductive wires 55 are provided) of the base material 56. As was described above, the contact pads 54 are members that are connected to the conductive wires 55, provided in a quantity that just matches the quantity of the conductive wires 55, and are provided aligned in tandem at predetermined intervals in the length direction of the base material 56. Note that while the insulating layer can be formed so as to cover the other surface of the base material 56 as needed, however, even in such cases, the upper surfaces of the contact pads 54 must be left uncovered. That is, the contact pads 54 are formed so as to be exposed on the outside surface of the wire substrate 51 wound onto the shaft member 11.

An opening not illustrated in the figures is formed in the base material 56 penetrating in a thickness direction in a position corresponding to each of the contact pads 54, and the conductive wires 55 and contact pads 54, which face each other, are connected by a conductive member not illustrated in the figures passing through the opening. For example, as illustrated in FIG. 4 and FIG. 5, a first conductive wire 551 and a first contact pad 541 are connected, a second conductive wire 552 and a second contact pad 542 are connected, a third conductive wire 553 and a third contact pad 543 are connected, and a fourth conductive wire 554 and a fourth contact pad 544 are connected.

Note that, as illustrated in FIG. 4, it is preferable that a wide part 55*a*, which is wider than other parts, be formed in a part that is connected to the contact pad 54 in each of the conductive wires 55. This allows the narrow conductive wires 55 to be easily and reliably connected to the contact pads 54. Furthermore, it is preferable that a terminal part 55*b* be formed in each of the conductive wires 55 closer to a tip than the wide part 55*a*, and that the conductive wires 55 not be present closer to the tip than the terminal part 55*b*. Note that the wide part 55*a* and the terminal part 55*b* can also be omitted as appropriate.

Furthermore, it is preferable that a dimension of the contact pad 54 relating to the length direction of the wire substrate 51 be longer than one wind of the wire substrate 51 helically wound onto the shaft member 11 in a state where the main body part 52 is completely wound onto the shaft member 11. For example, as illustrated in FIG. 6B, said dimension is one exposed continuously across about three winds of the main body part 52 of the wire substrate 51 helically wound onto the shaft member 11, and is set so as to be exposed across a predetermined length in the length direction of the shaft member 11. It is preferable that the predetermined length be a dimension corresponding to a length in the length direction of the counterpart housing 111 of the contacting arm part 152 in the counterpart terminal 151.

Furthermore, as illustrated in FIGS. 7A and 7B, it is preferable that a dimension relating to a width direction of the wire substrate 51 of the contact pad 54 be shorter than a width direction of the base material 56, and the same as a dimension of a range where the plurality of conductive wires 55 are present with respect to the width direction of the wire substrate 51. Because this forms a margin 56*a* where neither the contact pad 54 nor the conductive wire 55 are present on either width direction end of the base material 56, even if adjoining base materials 56 overlap one another when the wire substrate 51 is helically wound onto the shaft member 11, an overlapping part will not become thick because at least parts of the margins 56*a* will also overlap one another. Accordingly, the thickness of the main body part 52 of the wire substrate 51 wound onto the shaft member 11 becomes almost entirely uniform.

As was described above, the terminus of the cable 90 is connected to the proximal end of the free end 53 of the wire substrate 51. Specifically, as illustrated in FIG. 8, an electric wire connecting pad 57 is connected to a proximal end side of the free end 53 of each of the conductive wires 55. The electric wire connecting pads 57 are thin film or thin plate like members made from, for example, a conductive metal, such as a copper alloy, or the like, and are provided aligned on one surface of the base material 56 at about the same pitch as the conductive wires 55. Note that the surface of the electric wire connecting pad 57 is not covered by the insulating layer, and is thus exposed. Furthermore, an insulating cover is removed from the terminals of the plurality (four in the example illustrated in the figures, but not limited thereto) of electric wires 91 of the cable 90, and thus a core wire 92 made from a conductive metal such as a copper alloy, and the like, is exposed. Furthermore, each of the core wires 92 is electrically and securely connected to the surface of a corresponding electric wire connecting pad 57 via, for example, soldering, and the like.

In this way, the cable connector 1 according to the present embodiment is provided with the shaft member 11 and the wire substrate 51 helically wound onto the surface of the shaft member 11. Furthermore, the wire substrate 51 includes the band-shaped base material 56, a plurality of conductive wires 55 provided on one surface of the base material 56, and the plurality of contact pads 54 provided on the other surface of the base material 56, each of the conductive wires 55 is connected to each of the contact pads 54, and the contact pads 54 are exposed on the outside of the wire substrate 51 aligned so as to open a gap in a length direction of the shaft member 11, in a state where the wire substrate 51 is wound helically on the surface of the shaft member 11.

Therefore, the long thin cable connector 1 having the same outer diameter as the shaft member 11 can be obtained. Because the cable connector 1 is small in diameter, it can be provided even in narrow spaces. Furthermore, because the contact pad 54 is exposed to the outside, it can make reliable contact with the counterpart terminals 151 of the mating connector 101.

Moreover, the base material 56 includes a margin 56*a* on both width direction ends thereof, where neither the conductive wires 55 nor the contact pads 54 are present, and the margins 56*a* of the adjoining base materials 56 at least partially overlap one another, in a state where the wire substrate 51 is helically wound onto the surface of the shaft member 11. Accordingly, the thickness of the main body part 52 of the wire substrate 51 wound onto the shaft member 11 becomes almost entirely uniform, and the overlapped part does not become thick.

Additionally, the contact pads 54 are also formed connected in the length direction of the wire substrate 51 and are exposed on the outside of the wire substrate 51 over a predetermined length with respect to the length direction of the shaft member 11, in a state where the wire substrate 51 is helically wound onto the surface of the shaft member 11. Accordingly, the contact pads 54 can be brought into contact and thus made conductive with the corresponding counterpart terminals 151 of the mating connector 101.

Furthermore, the wire substrate 51 also includes the main body part 52 wound helically on the surface of the shaft member 11 and the free end 53 not wound helically on the surface of the shaft member 11, where the plurality of electric wire connecting pads 57 able to connect the terminals of the electric wires 91, which are the electric wire connecting pads 57 connected to the corresponding conductive wires 55, are connected to the free end 53. Accordingly, even if the electric wire 91 is extremely thin, it can be connected to a corresponding conductive wire 55.

A second embodiment will be described next. Note that the description omits descriptions of items with the same structure as in the first embodiment by attaching the same reference numbers thereto. Furthermore, the description of operations and effects that are the same as in the first embodiment will also be omitted.

Figure 9:
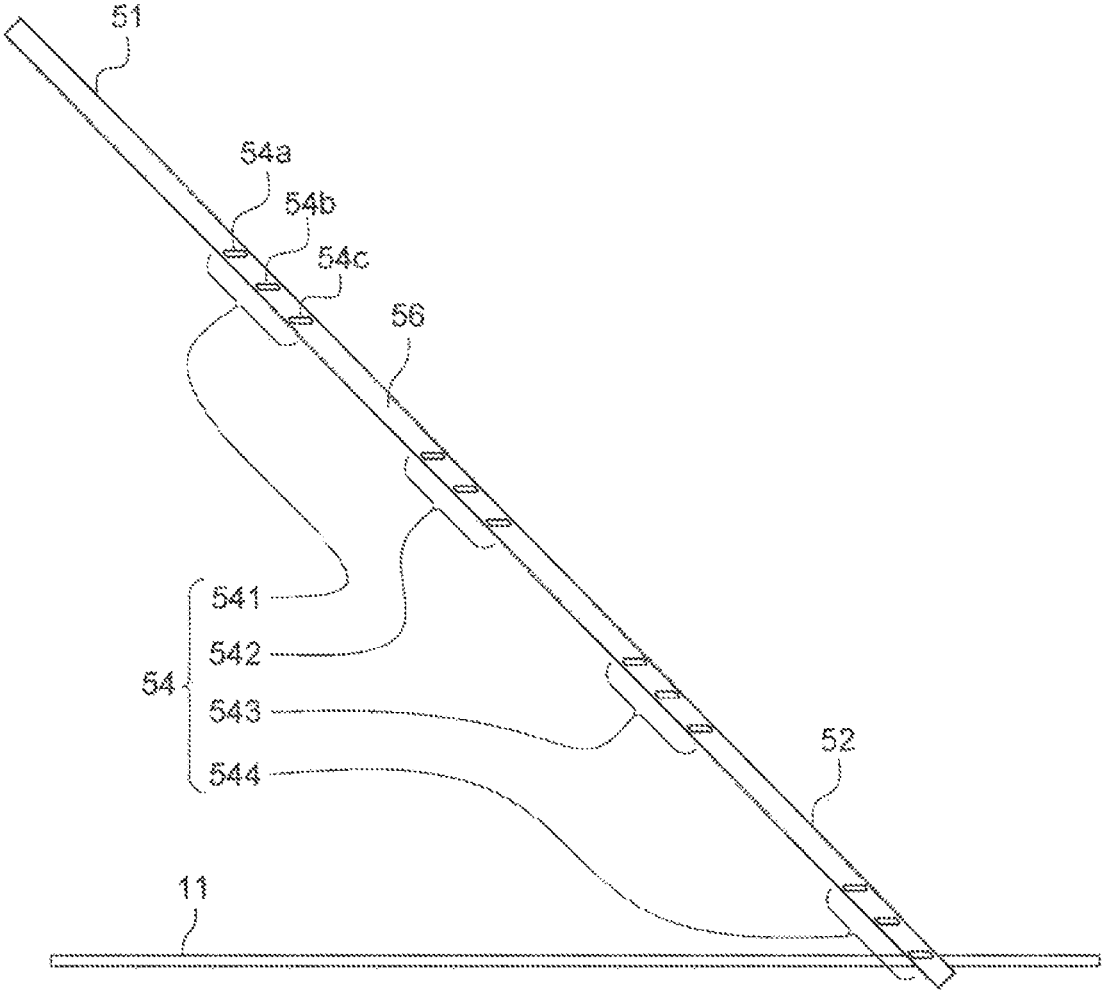
FIG. 9 is a view illustrating a state at the start of winding a wire substrate onto a shaft member according to a second embodiment.
Figure 10:
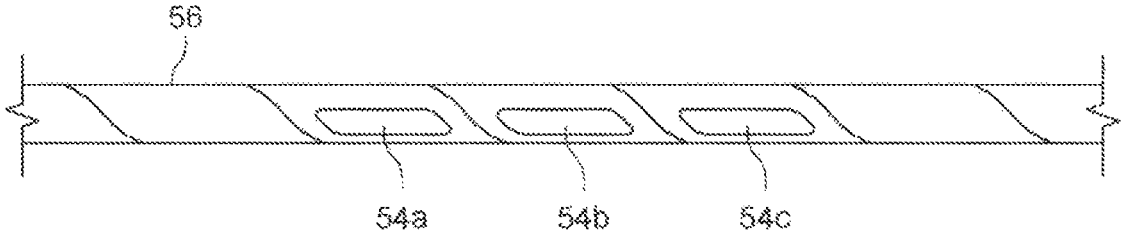
FIG. 10 is an enlarged view of main components illustrating a state at the end of winding the wire substrate onto the shaft member according to a second embodiment.

FIG. 9 is a view illustrating a state at the start of winding a wire substrate onto a shaft member according to a second embodiment and FIG. 10 is an enlarged view of main components illustrating a state at the end of winding the wire substrate onto the shaft member according to a second embodiment.

While the wire substrate 51 according to the present embodiment is provided with a contact pad 54 provided on the other surface (surface on the side opposite the surface where the conductive wire 55 is provided) of the base material 56, just as in the first embodiment, each of the contact pads 54 is divided into a plurality of pads, as illustrated in FIG. 9. Note that FIG. 9 is a view that corresponds to FIG. 5 described in the first embodiment, and is a view of state where the winding of the wire substrate 51 onto the shaft member 11 is started, as seen from the other side surface of the base material 56.

As illustrated in FIG. 9, the first contact pad 541, the second contact pad 542, the third contact pad 543, and the fourth contact pad 544, provided aligned in tandem at predetermined intervals in the length direction of the base material 56, are each divided into three parts forming a first pad part 54*a*, a second pad part 54*b*, and a third pad part 54*c*, respectively.

Furthermore, while the first pad part 54*a*, the second pad part 54*b*, and the third pad part 54*c* each form a long thin planar parallelogram as illustrated in FIG. 9, a length axis thereof is inclined with respect to the length direction of the wire substrate 51, and the parts are preferably parallel to the length direction of the shaft member 11 in a state where winding onto the shaft member 11 has begun.

Therefore, as illustrated in FIG. 10, the first pad part 54*a*, the second pad part 54*b*, and the third pad part 54*c* form a long thin row extending in the length direction of the shaft member 11 in a state where the winding onto the shaft member 11 of the wire substrate 51 has been completed.

Thus, while the contact pads 54 according to the present embodiment are exposed across the full extent of the circumferential direction on the outer surface of the main body part 52 wound onto the circumference of the shaft member 11, the contact pads 54 according to the present embodiment are only exposed in a limited narrow range in the circumferential direction on the outside surface of the main body part 52 wound onto the circumference of the shaft member 11. That is, each of the contact pads 54 is formed divided into a plurality of parts, those being the first pad part 54*a*, the second pad part 54*b*, and the third pad part 54*c*, so as to align opening intervals in the length direction of the wire substrate 51, and thus the first pad part 54*a*, the second pad part 54*b*, and the third pad part 54*c* form a long thin row extending the length direction of the shaft member 11 in a state where the wire substrate 51 is helically wound onto the shaft member 11. Accordingly, the contact pads 54 are only exposed to an extent necessary to make contact with the counterpart terminals 151 in the circumferential direction on the outside of the main body part 52, and are not exposed to any other extent, which thus dramatically reduces the chances of short circuits caused by their coming into contact with other conductive members, and the like.

Because the other points of the configurations of the cable connector 1 and the mating connector 101 according to the present embodiment are the same as in the first embodiment, descriptions thereof are omitted. Furthermore, because the operation for fitting the cable connector 1 and the mating connector 101 according to the present embodiment together is the same as in the first embodiment, a description thereof is omitted.

A third embodiment will be described next. Note that the description omits descriptions of items with the same structure as in the first and second embodiments by attaching the same reference numbers thereto. Furthermore, descriptions of operations and effects that are the same as in the first and second embodiments are also omitted.

Figure 11:
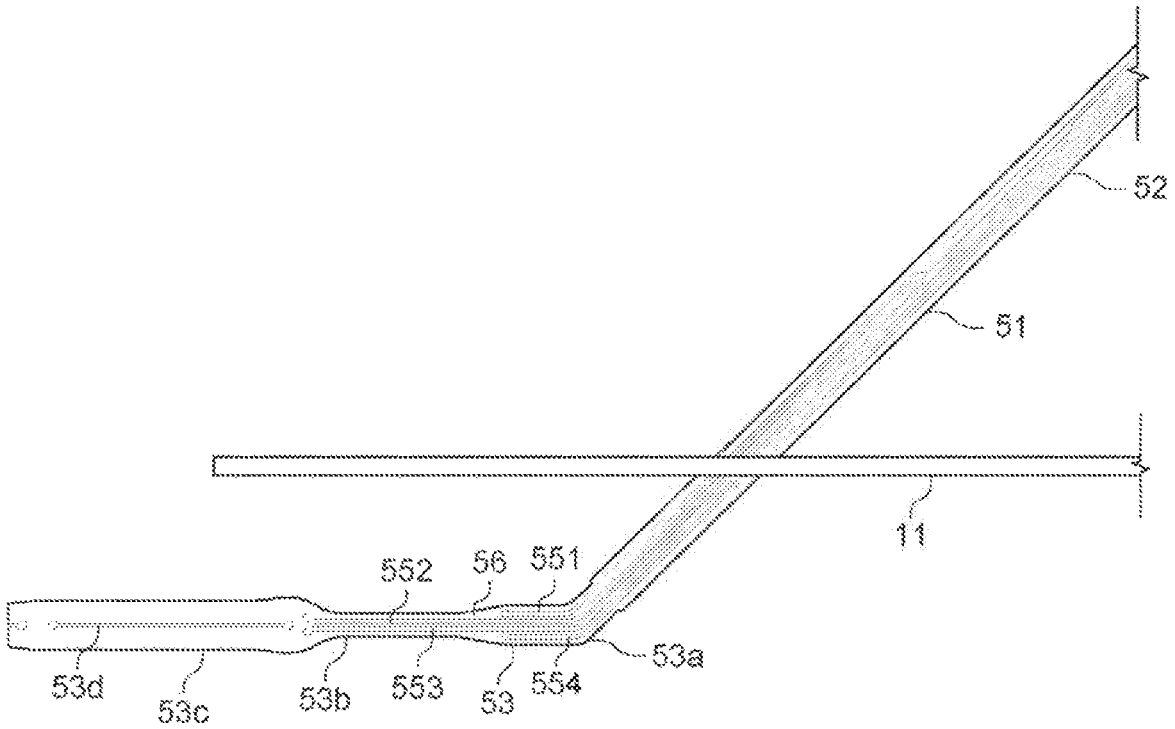
FIG. 11 is a view illustrating a part near a free end in a state at the start of winding a wire substrate onto a shaft member according to a third embodiment.
Figure 12:
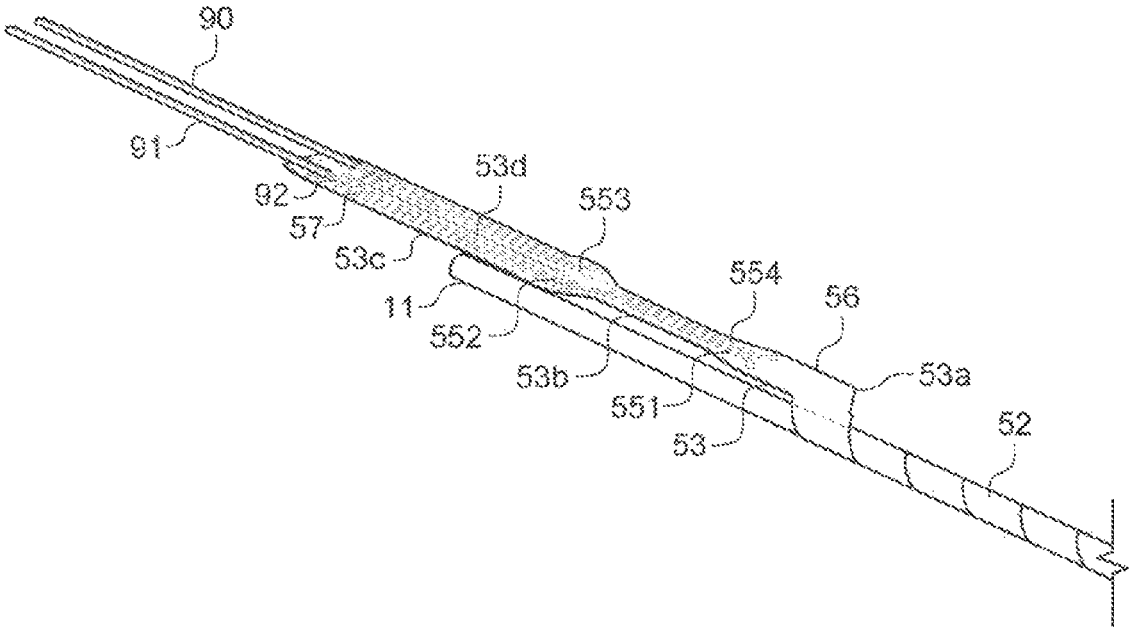
FIG. 12 is a view illustrating a part near a free end in a state at the end of winding the wire substrate onto the shaft member according to the third embodiment.
Figure 13:
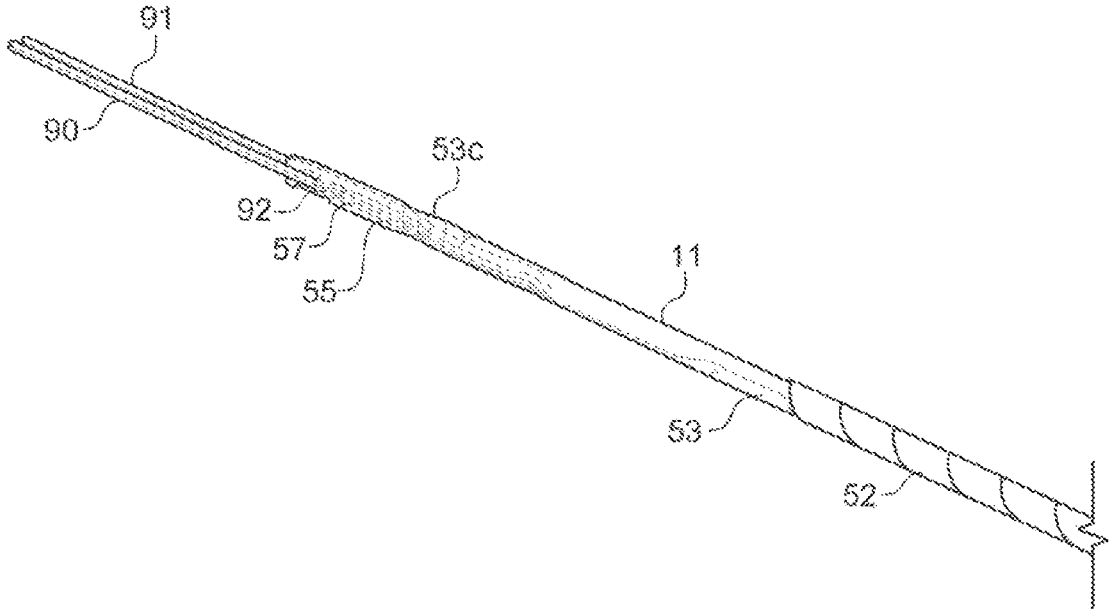
FIG. 13 illustrates a state where the free end of the wire substrate is folded according to the third embodiment.

FIG. 11 is a view illustrating a part near a free end in a state for commencing the winding of a wire substrate onto a shaft member in a third embodiment, FIG. 12 is a view illustrating a part near a free end in a state for finishing the winding of the wire substrate onto the shaft member according to the third embodiment, and FIG. 13 illustrates a state a where the free end of the wire substrate according to the third embodiment is folded.

Although the wire substrate 51 according to the present embodiment is provided with the free end 53 near a proximal end thereof, just as in the first embodiment, the free end 53 is connected via a corner 53*a* bent with respect to the main body part 52, as illustrated in FIG. 11. In other words, the length direction of the free end 53 is inclined with respect to the length direction of the main body part 52 and is thus parallel to the length direction of the shaft member 11 in a state where the winding of the main body part 52 onto the shaft member 11 has begun.

Furthermore, the free end 53 includes a narrow part 53*b* with a narrower width than other parts such as the main body part 52 or the like, and a folded part that is wider than the narrow part 53*b* and is connected to the narrow part 53*b*. Furthermore, a slit 53*d* is formed in the folded part 53*c* to extend in the longitudinal direction of the free end 53 around the width direction By the way, not all of the conductive wires 55 can be provided in parallel because the narrow part 53*b* is too narrow. Therefore, as illustrated in FIG. 11, only some (a second conductive wire 552 and a third conductive wire 553 in the example illustrated in the figure) of the plurality of conductive wires 55 are provided in the narrow part 53*b* on one surface of the base material 56, while, as illustrated in FIG. 12, the other conductive wires (a first conductive wire 551 and a fourth conductive wire 554 in the example illustrated in the figure) are provided on the other surface of the base material 56. In other words, several of the conductive wires 55 are provided in the narrow part 53*b* on both sides of the surface of the base material 56. Furthermore, all of the conductive wires 55 in the folding part 53*c*, which is wider than the narrow part 53*b*, are provided in the other surface of the base material 56.

In the example illustrated in the figure, the first conductive wire 551 and the fourth conductive wire 554 move from the one surface to the other surface of the base material 56 between the corner 53*a* and the narrow part 53*b*, and are thus present on the other surface of the base material 56 in the narrow part 53*b* and the folding part 53*c*. Note that an opening not illustrated in the figure is formed penetrating through the thickness direction of the base material 56 in a position facing the location where the first conductive wire 551 and the fourth conductive wire 554 end in the one surface of the base material 56, and a conductive member not illustrated in the figure connected to the location where the first conductive wire 551 and the fourth conductive wire 554 end is connected to the location where the first conductive wire 551 and the fourth conductive wire 554 start in the other surface of the base material 56 illustrated in FIG. 12.

Furthermore, the second conductive wire 552 and the third conductive wire 553 are parts that are close to the narrow part 53*b* in the folding part 53*c* and move from the one surface to the other surface of the base material 56, and are thus present on the other surface of the base material 56. Note that an opening not illustrated in the figure is formed penetrating through the thickness direction of the base material 56 in a position facing the location where the second conductive wire 552 and the third conductive wire 553 end in the one surface of the base material 56, and a conductive member not illustrated in the figure connected to the location where the second conductive wire 552 and the third conductive wire 553 end is connected to the location where the second conductive wire 552 and the third conductive wire 553 start in the other surface of the base material 56 illustrated in FIG. 12.

The conductive wires 55 are provided in the folding part 53*c* on both sides of the slit 53*d*. In the example illustrated in FIG. 12, the first conductive wire 551 and the second conductive wire 552 are provided on a lower side of the slit 53*d* in the figure, and the third conductive wire 553 and the fourth conductive wire 554 are provided on an upper side of the slit 53*d* in the figure. Furthermore, the electric wire connecting pad 57 is connected to a base end side (left end side in FIG. 12), of the folding part 53*c* in each of the conductive wires 55, and the core wire 92 exposed on the terminus of the electric wire 91 corresponding to the cable 90 is electrically and securely connected to the electric wire connecting pad 57.

As illustrated in FIG. 12, the length direction of the free end 53 is parallel to the length direction of the shaft member 11 in a state where the winding of the main body part 52 onto the shaft member 11 has ended. When, from this state, at least part (a part including all of the narrow part 53*b* and part of the folding part 53*c*) of the free end 53 is caused to abut the circumferential surface of the shaft member 11, and the folding part 53*c* is folded using the slit 53*d* as a fold, the free end and the folding appear as illustrated in FIG. 13. That is, the free end 53 of the cable 90 and the wire substrate 51 is able to achieve a state of extending linearly on the same axis as the shaft member 11.

In this way, the length direction of the free end 53 according to the present embodiment is also inclined with respect to a length direction of the main body part 52 and parallel to the length direction of the shaft member 11, and the free end 53 includes the narrow part 53*b* and the folding part 53*c* that is wider than the narrow part 53*b*, and the folding part 53*c* matches the slit 53*d* extending the length direction and is folded using the slit 53*d* as a fold. Furthermore, several of the conductive wires 55 are also provided in the narrow part 53*b* on the one surface of the base material 56 while the other conductive wires 55 are provided on the other surface of the base material 56, and all of the conductive wires 55 and the electric wire connecting pads 57 are provided in the folding part 53*c* on the other surface of the base material 56. Therefore, because at least part of the free end 53 is caused to abut the circumferential surface of the shaft member 11 and the folding part 53*c* can be folded, the entire outer diameter of the free end 53 becomes small to the same degree as the outer diameter of the shaft member 11. Accordingly, the cable connector 1 as a whole can become a rod-like member with a very small outer diameter.

Because the other points of the configurations of the cable connector 1 and the mating connector 101 according to the present embodiment are the same as in the first and second embodiments, descriptions thereof are omitted. Furthermore, because the operation for fitting the cable connector 1 and the mating connector 101 according to the present embodiment together is the same as in the first and second embodiments, a description thereof is omitted.

A fourth embodiment will be described next. Note that the description omits descriptions of items with the same structure as in the first through the third embodiments by attaching the same reference numbers thereto. Furthermore, descriptions of operations and effects that are the same as in the first through the third embodiments are also omitted.

Figure 14:
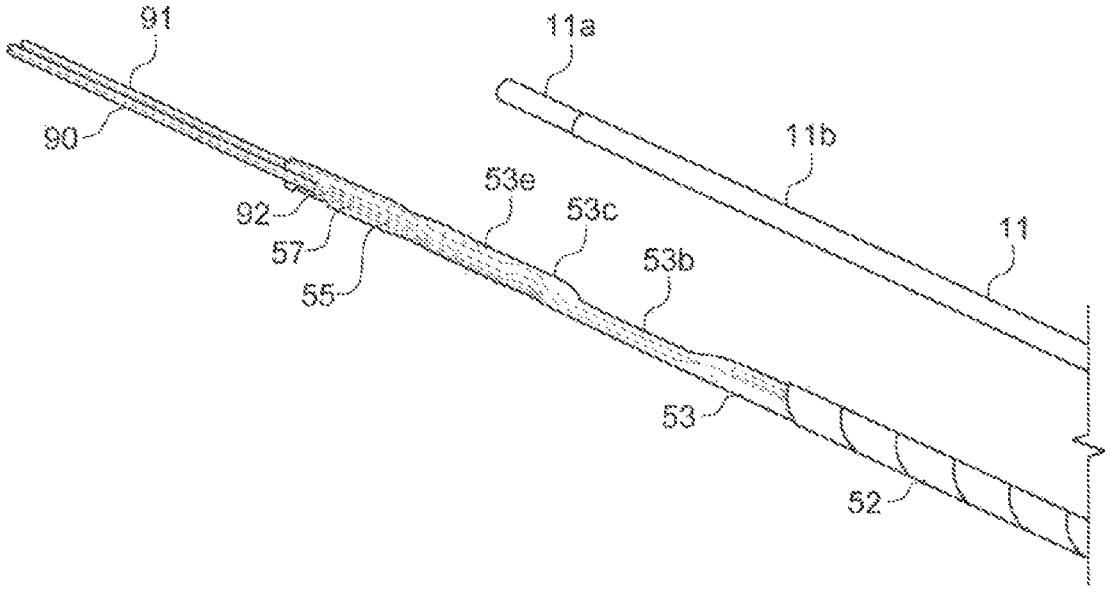
FIG. 14 is an enlarged, exploded view of main components of a cable connector in a state where the free end of a wire substrate is folded according to a fourth embodiment.
Figure 15:
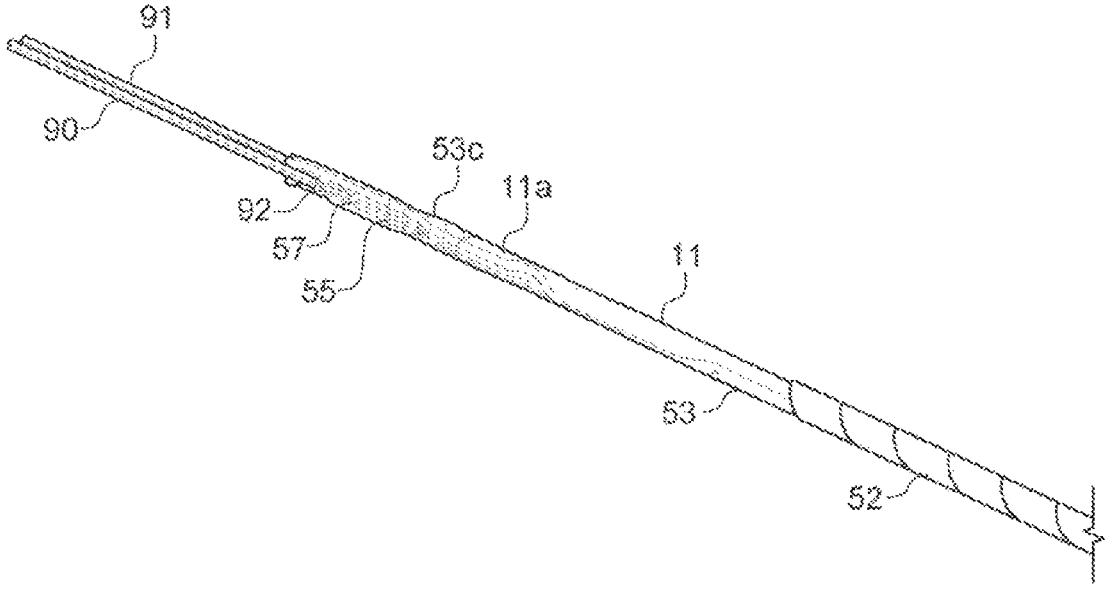
FIG. 15 is an enlarged perspective view of main components of the cable connector in a state where the free end of the wire substrate is folded according to the fourth embodiment.
Figure 16:
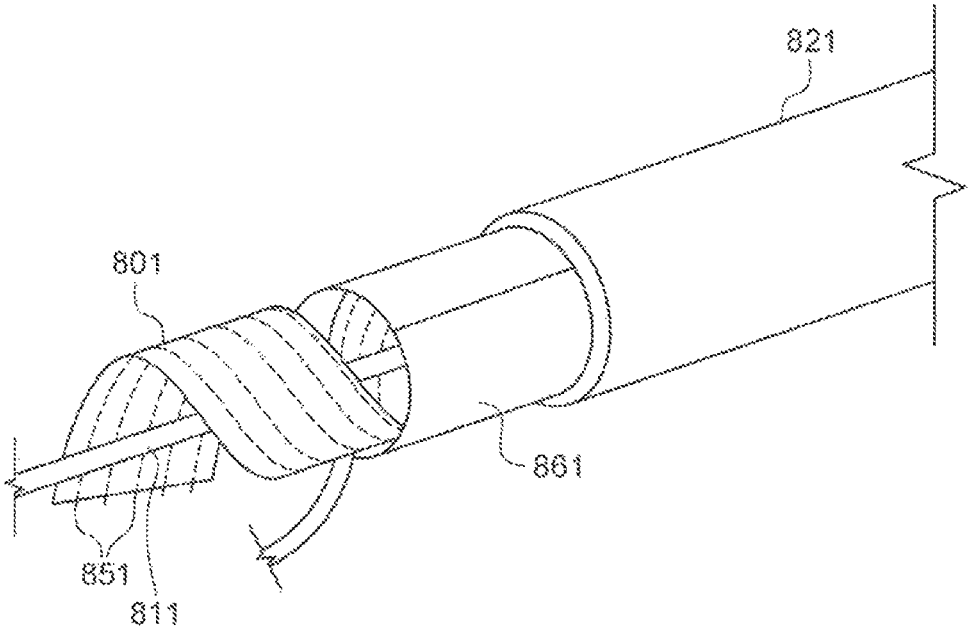
FIG. 16 PRIOR ART
FIG. 16 is a perspective view illustrating a conventional cylindrical cable.

FIG. 14 is an enlarged, exploded view of main components of a cable connector in a state a where the free end of a wire substrate in a forth embodiment is folded and FIG. 15 is an enlarged perspective view of main components of the cable connector in a state a where the free end of the wire substrate according to the fourth embodiment is folded.

Just as in the third embodiment, the free end 53 of the wire substrate 51 according to the present embodiment is connected bent with respect to the main body part 52, and includes the narrow part 53*b* and the folding part 53*c* in which the slit 53*d* has been formed. Furthermore, just as in the third embodiment, several of the plurality of conductive wires 55 are also provided in the narrow part 53*b* on both sides of the base material 56, and all of the conductive wires 55 are provided in the folding part 53*c* on the other surface of the base material 56. Moreover, just as in the third embodiment, in a state where the winding of the main body part 52 onto the shaft member 11 has been completed, at least part of the free end 53 is caused to abut the circumferential surface of the shaft member 11, and the folding part 53*c* is folded using the slit 53*d* as a fold.

Meanwhile, as illustrated in FIG. 14, the shaft member 11 according to the present embodiment is provided with a metal exposed part 11*a* where an insulating layer is not formed on a surface thereof near one end of a side corresponding to the free end 53 of the wire substrate 51. Note that the part other than the metal exposed part 11*a*, is an insulating film cover 11*b* where an insulating layer is not formed on a surface thereof.

Furthermore, a securing pad made from a metal, which is a part of one surface (surface where the conductive wire 55 is not provided) of the base material 56, is formed in the folding part 53*c* on a facing part 53*e* facing the metal exposed part 11*a*. Moreover, as illustrated in FIG. 15, at least part of the free end 53 is caused to abut the circumferential surface of the shaft member 11 in a state where the winding of the main body part 52 onto the shaft member 11 has been completed, and is securely connected to the securing pad formed on the metal exposed part 11*a* of the shaft member 11 and the folding part 53*c* in a state where the folding part 53*c* is folded using the slit 53*d* as a fold. Note that, as illustrated in FIG. 15, when soldering is performed, soldering can be performed by melting solder through the application of heat to a location where the metal exposed part 11*a* is exposed between both ends of the folding part 53*c*.

In this way, according to the present embodiment, the securing pad is formed in the folding part 53*c* on one surface of the base material 56, and the securing pad is secured via soldering to the metal exposed part 11*a* near one end of the shaft member 11. Therefore, the free end 53 is thus reliably secured to the shaft member 11 because at least part of the free end 53 is secured to the circumferential surface of the shaft member 11.

Note that the disclosure of the present specification describes characteristics related to preferred and exemplary embodiments. Various other embodiments, modifications and variations within the scope and spirit of the claims appended hereto could naturally be conceived by persons skilled in the art by summarizing the disclosures of the present specification.

The present disclosure can be applied to connectors.

The invention claimed is:

1. A connector comprising:

a shaft member having an outer cylindrical surface; and a wire substrate having a band-shaped base material, a plurality of conductive wires provided on a first surface of the base material, and a plurality of contact pads provided on a second, opposite surface of the base material, each conductive wire being connected to a respective one of the contact pads, wherein the wire substrate is wound helically onto the outer cylindrical surface of the shaft member such that the first surface of the base material faces the outer cylindrical surface of the shaft member and such that the second surface of the base material is exposed, wherein, where the wire substrate has been wound helically onto a length of the outer cylindrical surface of the shaft member, the wire substrate covers an entirety of the length of the outer cylindrical surface of the shaft member such that the entirety of the length of the outer cylindrical surface of the shaft member is not exposed; and wherein the contact pads are exposed and separated from one another in a length direction of the shaft member.

2. The connector according to claim 1, wherein the base material has a first margin on a first width direction end and a second margin on a second width direction end, neither the conductive wires nor the contact pads being present in either of the first or second margins, and wherein the first margin of a first winding of the wire substrate at least partially overlaps the second margin of a second winding of the wire substrate, where the first winding and the second winding are adjacent to one another.

3. The connector according to claim 1, wherein each of the contact pads are also formed connected in a length direction of the wire substrate and are exposed on the outside of the wire substrate over a predetermined length with respect to the length direction of the shaft member.

4. The connector according to claim 1, wherein each of the contact pads is formed split into a plurality of pad parts, where the pad parts form a long thin row longitudinal to the shaft member.

5. The connector according to claim 1, wherein the wire substrate has a main body part and a free end, the main body part being wound helically on the outer surface of the shaft member, the free end not being wound helically onto the outer surface of the shaft member, wherein the free end has a plurality of electric wire connecting pads configured to be connected, respectively, to a terminus of a respective electric wire of a cable, and wherein each electric wire connecting pad is connected to a respective one of the conductive wires.

6. The connector according to claim 5, wherein a length direction of the free end is inclined with respect to a length direction of the main body and parallel to the length direction of the shaft member, where the free end includes a narrow part and a folding part that is wider than the narrow part, and the folding part matches a slit extending the length direction and is folded using the slit as a fold.

7. The connector according to claim 6, wherein several of the conductive wires are provided in the narrow part on the first surface of the base material while other conductive wires are provided on the second surface of the base material, and all of the conductive wires and electric wire connecting pads are provided in the folding part on the second surface of the base material.

* * * * *